US005170722A

United States Patent [19]

Friesner et al.

[11] Patent Number: 5,170,722

[45] Date of Patent: Dec. 15, 1992

[54] PALLET ASSEMBLY

[75] Inventors: Charles E. Friesner, Pemberville; Donald G. Ferguson, Westerville, both of Ohio

[73] Assignee: Motion Products Company Limited Partnership, Sidney, Ohio

[21] Appl. No.: 634,516

[22] Filed: Dec. 27, 1990

[51] Int. Cl.[5] ..... B65D 19/12

[52] U.S. Cl. ..... 108/56.1; 108/902

[58] Field of Search ..... 108/56.1, 56.3, 51.1, 108/51.3, 901, 902

[56] References Cited

U.S. PATENT DOCUMENTS

| | | | |
|---|---|---|---|
| 2,997,266 | 8/1961 | Munroe | 108/51.3 |
| 3,157,423 | 11/1964 | Brie, Sr. | 108/56.1 X |
| 3,165,078 | 1/1905 | White | 108/56.1 X |
| 3,654,877 | 4/1972 | Barrett | 108/56.1 |
| 3,878,796 | 4/1975 | Morrison | 108/56.1 |
| 3,927,624 | 12/1972 | Hewson | 108/56.1 |
| 4,112,854 | 9/1978 | Pitchford | 108/56.1 |
| 4,359,948 | 11/1982 | Judy et al. | 108/56.1 |
| 4,497,260 | 2/1985 | Bucher | 108/56.1 |
| 4,843,976 | 7/1989 | Pigott et al. | 108/56.1 |

*Primary Examiner*—Jose V. Chen

*Attorney, Agent, or Firm*—Watkins, Dunbar & Pollick

[57] ABSTRACT

A pallet assembly is disclosed that consists of two sets of interlocking runners. The first set of runners has at least one opening capable of receiving a plurality of second runners. The second runners have slots that mate with the upper and lower members of the first runner so as to secure the first and second runners in fixed relation with each other. Typically the second runner is brought in fixed relation with the first runner by rotation of the second member. Locating bosses serve to locate the position of the second set of runners and assist in their rotation into fixed relation with the first runners.

12 Claims, 2 Drawing Sheets

PALLET ASSEMBLY

BACKGROUND OF THE INVENTION

1. Field of the Invention

This invention relates generally to pallets and more particularly to pallet assemblies made from components or runners that are easily interconnected and locked into place.

2. Description of the Prior Art

Representative examples of this art include U.S. Pat. No. 3,654,877 to Barrett which discloses a pallet with spaced round or square base members and smaller cross members that are held in place by dowel pins. The variety of sizes of base members, the required spatial relation among the members and the use of dowel pins to hold the members together make assembly of this unit complex. Furthermore the different sizes of the base members requires a full compliment of base members should one of the base members break and need to be replaced. U.S. Pat. No. 3,878,796 to Morrison discloses a pallet assembled from boards with notches and shoulders along their length. The notches and shoulders mate with corresponding shoulders and notches in support stringers. This construction suffers from the fact that the boards have no support in the spans between the stringers. The only way that additional stringers can be added or removed is by shifting some of the stringers already installed. The system of notches and shoulders is also susceptible to dirt and breakage.

U.S. Pat. No. 3,927,624 to Hewson discloses a knock down pallet with parallel first beam elements having support posts with notches and second beam elements having support posts with mating slots which engage each other. Such a construction limits the number of beam members per unit area to the spacing of the interconnecting support posts on the first and second beams. U.S. Pat. No. 4,359,948 to Judy, et al. shows interconnecting pallet stringers that use a set of projections and detents on a first set of stringers that mate with slots, locking nipples and ridges on a second set of stringers. Again the number of beam members per unit area is limited by the position of the interconnections. U.S. Pat. No. 4,497,260 to Buche discloses a pallet made from essentially two long beams joined together by cross beams where the members forming the long beam are held together by wedges.

The prior art pallet assemblies have members with complicated construction and complicated interconnecting parts. Some assemblies require special fasteners to interlock the components. The position of the interlocking parts of the pallet members often limits the number of support members that can be used per unit area of the pallet. Moreover the complexity and detail of the interlock mechanism often makes it very difficult to remove broken members and insert new members. The complex detail of the interlock mechanism is also subject to failure as a result of the accumulation of dirt and other foreign matter in the groves, notches, slots, detents, nipples and ridges of the interlock mechanisms.

SUMMARY OF THE INVENTION

The various problems encountered with previous attempts to construct a pallet assembly that is easy to put together and take apart, requires no special fasteners and can be adapted to a wide variety of weight and strength requirements by simply adding or removing pallet components or runners have been solved with the present invention. The ease of insertion or removal of the components is especially useful for repairing damaged members of the assembly. The ease of assembly and disassembly and the simple design enable the present pallet to meet the hygiene standards of the foodstuff industry. By choosing the appropriate materials for the pallet assembly, runners and even the pallet itself can be conveniently recycled when damaged or no longer needed. Moreover the pallet components themselves can be constructed from recycled materials.

The present invention consists essentially of two interlocking sets of runners. In their basic design, both sets of runners have essentially parallel upper and lower members. Each runner of the first set of runners has at least one enclosed opening that is capable of receiving a plurality of runners from the second set of runners. Each of the second set of runners has outer slots on the upper member, lower member or both members of the runner. As appropriate, the slots of the second members mate with the upper member or lower member or both members of the first runner. The slots of the second runner form a force fit with the upper member or lower member or both members of the first runner that secures the first and second runners in fixed relation with each other. Preferably, the slots of the second runner are formed in pairs with the first and second slots of each pair being diametrically opposed to each other so that each pair of slots mates with the upper and lower members of the first runners.

To assemble the pallet, the second runner is held in a generally horizontal position and inserted into an enclosed opening of the first runner and rotated into a vertical position so that the slots of the second runner mate with the upper member or lower member or both members of the first runner so as to bring the second and first runners in fixed relation with each other. The slots of the second runner and the upper and lower members of the first runner typically contact each other with a force fit. To achieve the force fit, a tool can be used to rotate the second runners with their associated slots into position with the first runners.

To conserve fabrication material, both the first and second runners can be formed with enclosed openings. Although it is possible to have one long opening in each runner, it is often preferable to add additional support cross members that attach to the upper and lower members of the first and second runners. These cross members provide additional rigidity and strength to the runners, especially to the upper member of the runners and, in the case of the first runner, help to maintain the interlock between the first and second runners.

In order to facilitate the rotation of the second runner so as to bring its slots in mating relation with the sides of the first runner, locator bosses are provided on the interior surfaces of either the lower member or upper member or both members of the first runners. These bosses assist in locating and holding the second runner in fixed relation with the first runner while the second runner is rotated into locking position with the first runner.

Although the runners of the pallet can be made of any suitable material including such materials as wood or metal, the use of plastics and especially thermoplastics is preferred. In order to reduce costs, the use of a recycled material such as high density polyethylene has proven to be particularly advantageous for this invention. Pallets formed of a recyclable plastic are especially advantageous in that the pallets or portions thereof can also be recycled.

The pallet runners can be made by a wide variety of methods. Preferably injection molding, and especially structural foam injection molding can be been used to form pallet assembles that are strong and durable. Generally the height of the first and second runners are about equal for maximum structural (load) support. However, it is to be understood that varying heights of the two members can be employed depending on the particular application. One of the advantages of the present pallet assembly is that various openings can be provided in the runner for forklift fingers, packaging, stacking and other specific needs of the user.

The foregoing and other advantages of the invention will become apparent from the following disclosure in which one or more preferred embodiments of the invention are described in detail and illustrated in the accompanying drawings. It is contemplated that variations in procedures, structural features and materials, and arrangement of parts may appear to a person skilled in the art without departing from the scope of or sacrificing any of the advantages of the invention.

Figure 1:
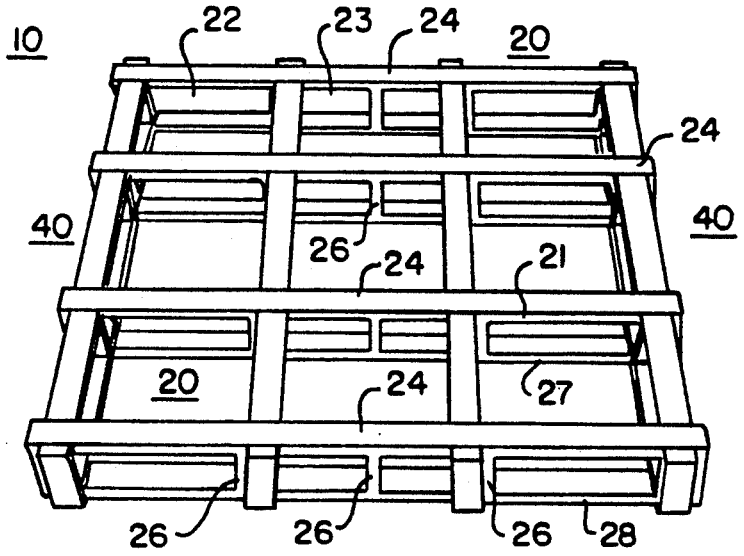
FIG. 1 is a perspective view of the pallet assembly of this invention.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although one or more preferred embodiments of the invention have been herein described, it is to be understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

Figure 2:
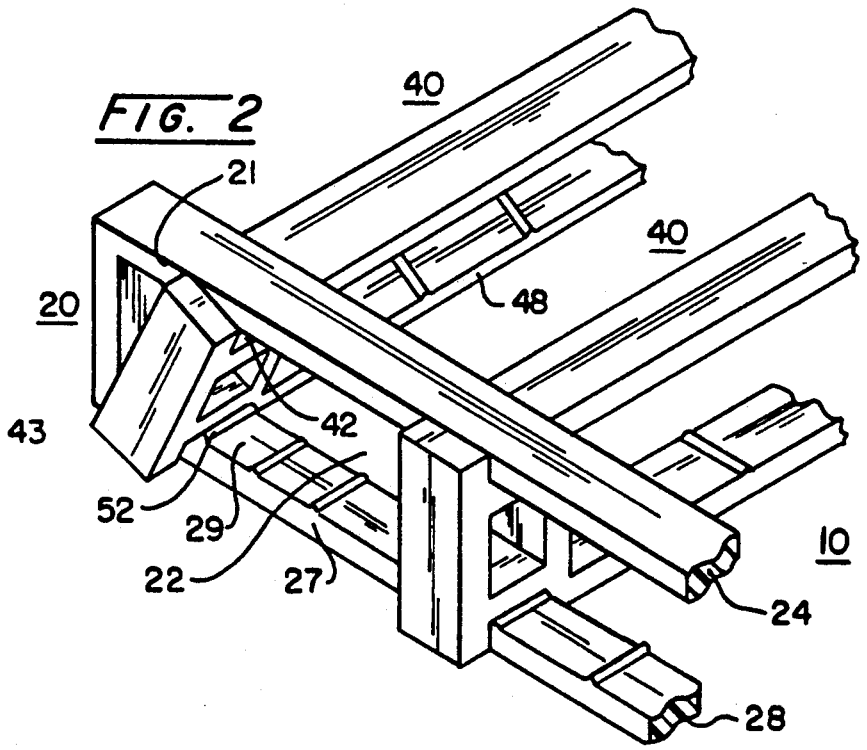
FIG. 2 is an isometric view partially broken away to show the rotation of the second runner into an interlocking position with the first runner.
Figure 3:
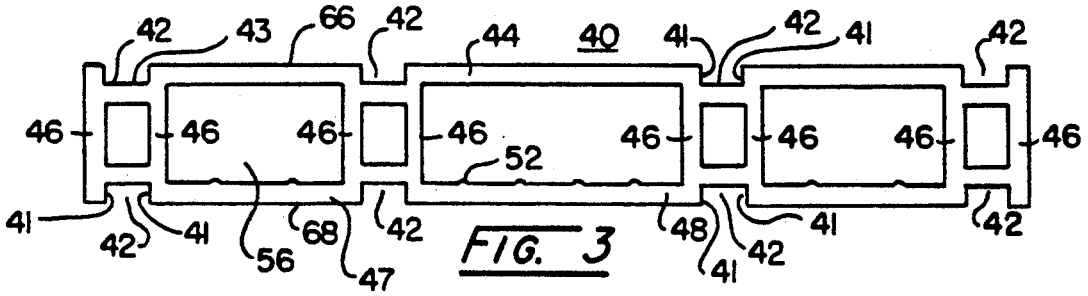
FIG. 3 is side view of the second runner showing the interlocking slots.

As shown in FIG. 1, the assembled pallet 10 of this invention is comprised of first runners 20 and second or cross runners 40. The first runners 20 have openings such as opening 22 and opening 23 of sufficient size so as to be capable of receiving second runners 40. The first and second runners, 20 and 40, respectively, are secured in fixed relation with each other by means of outer slots 42 on the second runner 40 (FIGS. 2 and 3).

It is to be noted that one of the advantages the present pallet assembly is the wide variety of configurations that the assembled pallet 10 can take. The first and second runners, 20 and 40, can be made in a variety of lengths to give a wide variety of pallet sizes. For example, by making runners 20 and 40 of about the same length, a square pallet is obtained. By making runners 20 longer than runners 40, a rectangular pallet can be achieved.

It is possible to have a single opening 22 (FIG. 2) in first runner 20 through which the second or cross runners are inserted and rotated into fixed position with runner 20. By suitable positioning of slot 42 and support members 46 as shown in FIG. 3, cross runner 40 gives additional support to the upper member 24 of runner 20. Thus it is especially advantageous in that as many cross runners 40 as are necessary can be added and used with runners 20 so as to strengthen and support upper members 24. In addition to the support provided by runner 40, it is desirable to add additional support cross members 26 between the upper member 24 and the lower member 28 of the first runner 20. The support cross members 26 serve at least two basic functions. First, that they give support to the upper member 24. Second, the support cross members 26 ensure that the interlock between the runners 20 and 40 is securely maintained. As noted in FIG. 5, the upper member 24 of runner 20 undergoes a small amount of distortion as the cross runner 40 is rotated into place. To prevent undue flexing of upper member 24 in other than assembly and dissembly of the pallet, it is desirable to incorporate support members 26 into the structure of first runner 20 so as to maintain a firm slot interlock between runners 20 and 40.

As noted previously, support cross members 46 are used to give structural support and rigidity to second runner 40. In addition, support cross members 46 can be positioned so as to give support to slot 42 which in turn gives support to the upper member 24 and lower member 28 of the first runner 20. As shown in FIGS. 1–5, the support cross members 26 and 46 for the first and second runners 20 and 40, respectively, are preferably constructed as vertical cross pieces between the horizontal upper and lower members 24 and 28 and upper and lower members 44 and 48 of the first and second runners 20 and 40, respectively. However, a wide variety of other constructions are available for the support cross members including triangular shapes, radial support corners, and even solid segments. For second runner 40, the entire runner can be constructed as a single solid beam with slots 42 that is equivalent to the runner shown in FIG. 3. Although solid sections, triangular truss type structures, and other configurations could be used for the support cross members 26 in first runner 20, it must be realized that there must be one or more apertures or openings such as openings 22 and 23 that allow for the insertion of runners 40 into the opening so as to interlock the first and second runners 20 and 40.

Figure 4:
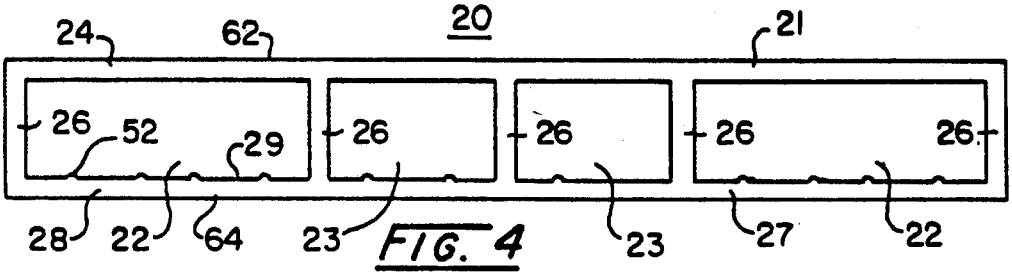
FIG. 4 is a side view of the first runner illustrating the enclose openings through which the runner of FIG. 3 is inserted.

When runner configurations such as depict ed in FIGS. 3 and 4 are used, typically the upper members 24 and 44 and the lower members 28 and 48 are essentially parallel to each other and are of approximately the same thickness. However, variations that are considered to be equivalent to these structures are possible. For example, the lower members 28 and 48 may be of a lesser thickness than the upper sides 24 and 44 so as to accommodate various size forklifts and their clearance with a supporting surface such as the floor. By using the structure illustrated for runners 20 and 40 shown in FIGS. 3 and 4, it is possible to place the cross runners 40 at appropriate distances from each other so as to accommodate the forks of typical forklifts.

In those instances in which it is necessary to accommodate a lifting mechanism for which there is no clearance between the floor and the lifting mechanism, it may be necessary to eliminate segments of the lower member 28 and 48 of the runners 20 and 40. When segments of runner 20 are eliminated, it is to be understood that one or more openings must be provided in runner 20 to accommodate the second or cross runners 40 and their associated slots 42 so as to provide an interlock with runners 20.

As shown in FIG. 3, slots 42 are formed in the second or cross runner 40 of such a width and depth so as to accommodate the upper and lower members 24 and 28 of the first runner 20. Preferably these slots are diametrically opposed so as to enable ease of insertion and alignment of the slots with the upper and lower members 24 and 28 of runner 20. Generally the width of slot 42 should be the same as the width of the upper and lower members 24 and 28 of runner 20 so as to provide a tight or force fit between the sides 41 of slot 42 and the sides 21 of the upper member 24 and the sides 27 of the lower member 28 of the first runner 20.

Although various shapes for slots 42 are possible, the rectangular shape shown in FIG. 3 is preferred. When other shapes are used, they must be of such construction as to provide a force fit between the slot 42 of runner 40 and upper and lower members of the runner 20.

As shown in FIG. 3, the slots are arranged in pairs that are diametrically opposed to each other so as to accommodate the upper member 24 and lower member 28 of runner 20. However, such arrangement of pairs of slots 42 are not necessary. For example it is only necessary that slots 42 occur on either the upper outer edge 62 of member 44 or the lower outer edge 64 of member 40 and that these upper or lower slots 42 mate with either the upper member 24 or the lower member 28 of the runner 20. When slots are used only on the upper member 44 of runner 40, it is to be realized that the bottom member 48 will not be flush with the bottom member 28 of member 20. Preferably, the width of runners 20 and 40 are essentially equal so as to facilitate support and weight distribution. However, as noted, they can be unequal to accommodate the specific needs of the pallet user.

As seen in FIGS. 3 and 4, the outer surfaces of 62 (top), 64 (bottom), 66 (top) and 68 (bottom) of the members 24, 28, 44, and 48, respectively, are flat. However, it should be realized that indentations or other special configurations can be formed in these members to accommodate the shape or other requirements of materials that are to be supported or used with pallet 10. For example, solid sheets of material can be used to cover the top of the pallet when small objects are to be stacked on the pallet. Solid sheets of material can be attached to the bottom of the pallets when loaded pallets are stacked one on top of another—the bottom sheet serving to distribute the weight and prevent damage to the materials stacked on the pallet beneath it.

Figure 5:
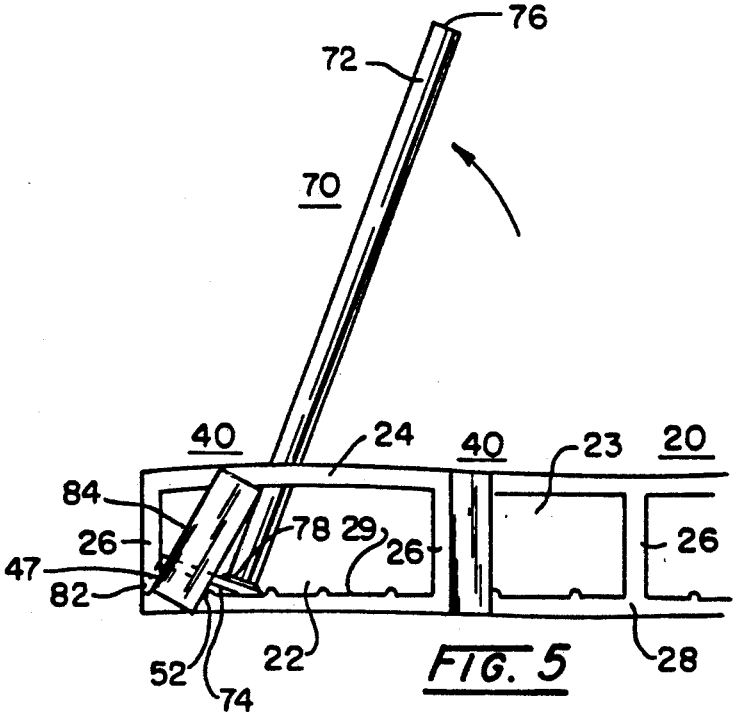
FIG. 5 illustrates a tool for rotating the second runner into position with the first runner.

As shown in FIG. 2, the pallet assembly 10 is assembled by placing the second or cross runner 40 through the opening 22 in the first runner 20. The runner 40 is held in a generally horizontal position when it is inserted into an opening 22 in runner 20, it being understood that the exact position in which runner 40 is held depends on the shape of an opening such as opening 22 into which runner 20 is inserted. The runner 20 is inserted until a slot 42 aligns with the lower member 28 of runner 20. When the lower slot 42 aligns with the lower member 28 of runner 20, the upper slot 42 is in alignment with the upper member 24 of runner 40. At this point and as shown in FIG. 2, runner 40 is at a slight angle from perpendicular. Runner 40 is then rotated so as to bring it into a vertical position causing the slots 42 to mate with the upper member 24 and lower member 28 of runner 20. This is further illustrated in FIG. 5 where tool 70 is being used to rotate the second runner 40 into position with runner 20. As shown in FIG. 5, the upper member 24 (and to some extent lower member 28) distorts somewhat as runner 40 is brought into vertical position. As a result, the materials used to construct the pallet members must be of sufficient flexibility and elasticity so as to prevent cracking, breakage or distortion during the assembly and disassembly process. Once the runner 40 is brought into its vertical position, the bend in upper and members 24 and 28 disappears thereby maintaining slots 42 of member 40 into a locked and upright position with member 20. To maintain a good lock between runners 20 and 4J, it is essential that members 24 and 28 have sufficient elasticity to return to their original undistorted state after being rotated into or out of position. As a result, Although the assembly procedure has been illustrated and described for one runner 20, it is to be understood that runner 40 is usually inserted into the openings of a plurality of runners 40 and that each runner 40 is aligned with runner 20. Then runner 20 is rotated into position with the plurality of runners 40.

To facilitate the location and rotation of runners 40 into position with runner 20, it is desirable to have locator bosses 52 on an interior side 29 of the lower member 28 of runners 40 (FIGS. 2, 4 and 5). As shown in FIG. 2, the bottom edge 43 of slot 42 is placed in contact with the locator boss 52. The locator boss 52 serves to keep the lower member 48 of runner 40 in fixed relation with the lower member 28 of runner 20 while runner 40 is being rotated into a vertical position. The locator boss 52 also serves to align runner 40 in fixed relation with respect to a plurality of first runners 20.

Since the fit of slot 42 with the upper and lower members 24 and 28 of runner 20 is preferably a force or friction fit, it is advantageous to use a tool to rotate the second or cross runner 40 into position with respect to runner 20. In its simplest form, the tool may be a piece of pipe or a board that is inserted into the openings of runner 40 in order to rotate the runner 40 into position. To accomplish this rotation, a suitable board or pipe is placed through an opening in member 40 and a rotational force exerted upon the tool so as to rotate runner 40 into position. As shown in FIG. 5, a special tool 70 has been developed to accomplish this rotation. The tool 70 consists of a handle 72 which in simple form may be a piece of pipe and an L-shaped member 74. One end 78 of the pipe is attached near the end of the wide surface of the long part of the L-shaped member 74. The short part 82 of the L-member 74 passes through an opening 56 in runner 40 and hooks around the side 47 of member 48. The pipe contacts the upper member 44 of runner 40 near its lower end 78. A rotational force is exerted at the other end 76 of the pipe (handle) 72 in order to rotate runner 40. It is noted, that a wide variety of implements can be used to rotate the second or cross member 40 into position. Such implements include screwdrivers, pipes, metal bars, and almost any long member that is capable of being inserted through an opening such as opening 56 (FIG. 3) of runner 40 and having sufficient length to rotate and force slots 42 of runner 40 and upper and lower members 24 and 28 of member 20 into a mating relation. Although the use of the tool 70 and the locator bosses 52 have been illustrated with the runner 40 being first set against a locator boss 52 on the lower member 28 of runner 40 and then rotated into position with the upper member 24 of runner 40, it is to be understood that the reverse procedure, i.e., placing the runner 40 against a locator 52 on the upper member 24 and rotating runner 40 into position with lower member 28, is equivalent to the procedure described.

The runners 20 and 40 can be constructed of a wide variety of materials including wood, metal or plastics. Generally these materials should have sufficient flexibility and elasticity so as to enable the slight flexing required to achieve a good mate between the slot 42 and the upper or lower member 28 of the runner 40. The flexing can be eliminated to some extent by rounding the corners 43 of the slot 42 (FIG. 3). However, it is noted that such rounding will tend to reduce the tightness of the fit between the slots 42 and the upper and lower members 24 and 28 of runner 20.

Preferably plastic materials including thermoset plastics and thermoplastics may be used for the construction of the runners 20 and 40. The choice of materials depends largely on the use of the assembled pallet. For general purpose pallets, polyethylene or polypropylene are appropriate thermoplastics. By using thermoplastics, it is possible and preferred to use recycled plastics. The use of thermoplastics also enables the pallet runners 20 and 40 to be recycled should they become damaged or defective. As a result, the environmental disposal problems encountered with wood pallets are avoided, i.e., wood pallets cannot be conveniently burned and often they are refused by haulers or landfill facilities. As a result, they often accumulate along side of the buildings where they were once used.

The runners 20 and 40 can be formed using an injection molding process. For general purpose pallets, structural foam injection molding is preferred. Typical parts made by structural foam injection molding have a surface made up of collapsed cells that provide a strong and solid support skin that has a swirled pattern somewhat similar to wood. One of the major advantages of this process is that the foaming action completely fills even large ribs and bosses leaving a flat surface. Structural foam injection molding is especially appropriate for the size and stiffness of the pallet runners 20 and 40.

It is possible that changes in configurations to other than those shown could be used but that which is shown is preferred and typical. Without departing from the spirit of this invention, a side variety of materials and processes can be used to make the runners of this invention.

It is therefore understood that although the present invention has been specifically disclosed with the preferred embodiment and examples, modifications to the design concerning sizing and shape will be apparent to those skilled in the art and such modifications and variations are considered to be equivalent to and within the scope of the invention and the appended claims.

We claim:

1. A pallet assembly comprising:

a. a plurality of first runners, each having:
   1) an upper, first-runner member; and
   2) a lower, first runner member;
   3) said upper and lower, first-runner members having an interior surface defining an opening between said upper and lower, first-runner members; and
   4) said interior surface having a locating means comprising at least one locator boss;

b. a plurality of second runners, each having:
   1) an upper, second-runner member; and
   2) a lower, second-runner member
   3) at least one member of said upper and lower, second-runner members having an outer slot;

c. each of said second runners being received into said openings of said first runners;

d. said second runners contacting at least some of said locator bosses of said first runners; and e. said second runners being secured to said first runners by means of said outer slots that engage and mate with members of said first and second, first-runner members so as to secure said first runners to said second runners in essentially orthogonal, fixed relation with each other.

2. A pallet assembly as recited in claim 1 wherein said slots of said second runner are formed in pairs with the first and second slots of said pair of slots being diametrically opposed to each other and with said first slot of said pair mating with said upper member of said first runners and said second slot of said pair mating with said lower member of said first runners.

3. A pallet assembly as recited in claim 1 with said first runners further comprising support cross members that attach to said upper and lower members of said first runners.

4. A pallet assembly as recited in claim 1 with said second runners further comprising support cross members that attach to said first and second members of said second runners.

5. The pallet assembly as recited in claim 1 wherein said first and second runners are thermoplastic.

6. The pallet assembly as recited in claim 5 wherein said thermoplastic is a recycled thermoplastic.

7. The pallet assembly as recited in claim 6 wherein said recycled thermoplastic is polyethylene.

8. The pallet assembly as recited in claim 1 wherein said first and second runners are formed by injection molding.

9. The pallet assembly as recited in claim 8 wherein said injection molding is structural foam injection molding.

10. The pallet assembly as recited in claim 1 wherein said height of said first and said second runners is about equal.

11. The pallet assembly as recited in claim 1 further comprising a tool for rotating said second runner so that said slots of said second runner are brought into mating relation with at least one member of said first and second members of said first runners.

12. The pallet assembly as recited in claim 11 with said tool further comprising:

(a) a handle, (b) an "L" shaped member attached near the end of a wide side of its long end to said handle.

* * * * *